United States Patent [19]

Nixon, II

[11] Patent Number: 4,779,778

[45] Date of Patent: Oct. 25, 1988

[54] MUSIC ARTICLE JEWELRY SYSTEM

[76] Inventor: George D. Nixon, II, 15 Hollywood Ct., Mount Clemens, Mich. 48043

[21] Appl. No.: 930,230

[22] Filed: Nov. 13, 1986

[51] Int. Cl.[4] ..... G10G 7/00

[52] U.S. Cl. ..... 224/269; 224/220; 224/247; 224/910

[58] Field of Search ..... 84/320, 322, 258; 24/647, 643, 458, 510; 224/219, 220, 221, 222, 267, 910, 269, 247, 252

[56] References Cited

U.S. PATENT DOCUMENTS

| | | | |
|---|---|---|---|
| 353,482 | 11/1886 | Cottle | 63/20 |
| 676,277 | 6/1901 | Robertson | 24/3 R |
| 734,142 | 7/1903 | Smith | 24/3 R |
| 764,951 | 7/1904 | Landau | 24/3 M |
| 780,962 | 1/1905 | Perry | 24/3 K |
| 784,565 | 3/1905 | Hoskins | 285/284 |
| 982,298 | 1/1911 | Pollock | 24/536 |
| 1,077,025 | 10/1913 | Whitehead | 63/18 |
| 1,089,340 | 3/1914 | Hemphill | 24/155 R |
| 1,184,561 | 5/1916 | Napoletano | 84/322 |
| 1,344,500 | 6/1920 | Giardino | 24/510 |
| 1,455,879 | 5/1923 | Gronlund | 24/3 R |
| 1,475,974 | 12/1923 | Torrey | 24/3 M |
| 1,618,698 | 2/1927 | Colon | 24/3 R |
| 1,683,545 | 9/1928 | Harris | 63/1.1 |
| 1,900,425 | 3/1933 | Benjamin | 63/20 |
| 2,572,889 | 10/1951 | Strykower | 224/258 |
| 2,911,694 | 11/1959 | Seron | 24/371 |
| 2,947,456 | 8/1960 | Seron | 224/258 |
| 2,957,216 | 10/1960 | Mule | 24/3 B |
| 3,124,286 | 3/1964 | Dompier | 224/220 |
| 3,326,431 | 6/1967 | Bellini | 224/182 |
| 3,686,894 | 8/1972 | Handler et al. | 63/19 |
| 3,894,464 | 7/1975 | Brooks | 84/327 |
| 4,067,255 | 1/1978 | Camaioni | 84/322 |
| 4,137,814 | 2/1979 | Rowley | 84/322 |
| 4,271,684 | 6/1981 | Tisdale | 63/19 |

*Primary Examiner*—Renee S. Luebke

*Attorney, Agent, or Firm*—Harness, Dickey & Pierce

[57] ABSTRACT

An apparatus for removably yet stably retaining and attractively suspending an article used for playing a musical instrument is disclosed. The apparatus, which can double as a jewelry system, includes a spring-loaded clip having two opposing arms, one of which includes a stabilizing projection. The clip removably retains a pick and a pick sleeve encasing the pick. Both the pick and pick sleeve have slots through their planar surfaces which receive the stabilizing projection of the clip arm when the encased pick is retained by the clip. The apparatus also includes a flexible loop element connected to the clip which loops upon itself and allow the clip and encased pick to be suspended from any structure encircled by the looped element.

20 Claims, 2 Drawing Sheets

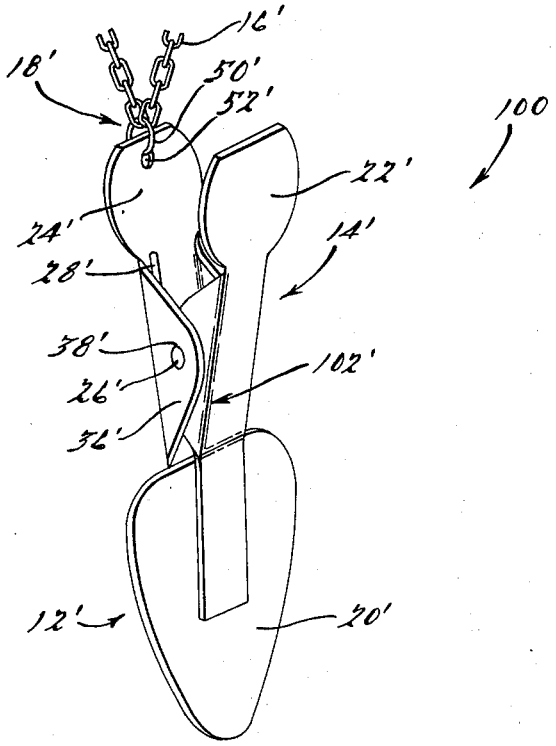
FIG. 7.
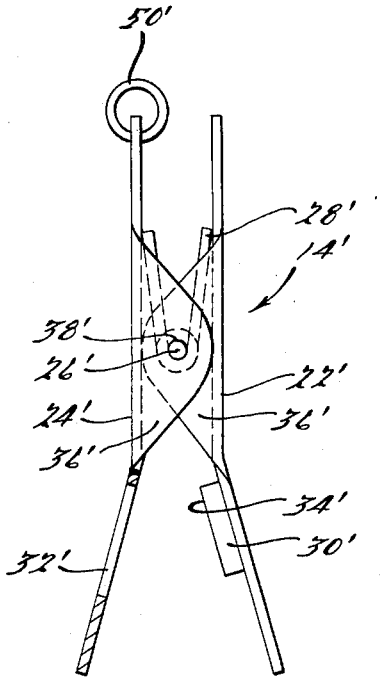
FIG. 10.
FIG. 9.
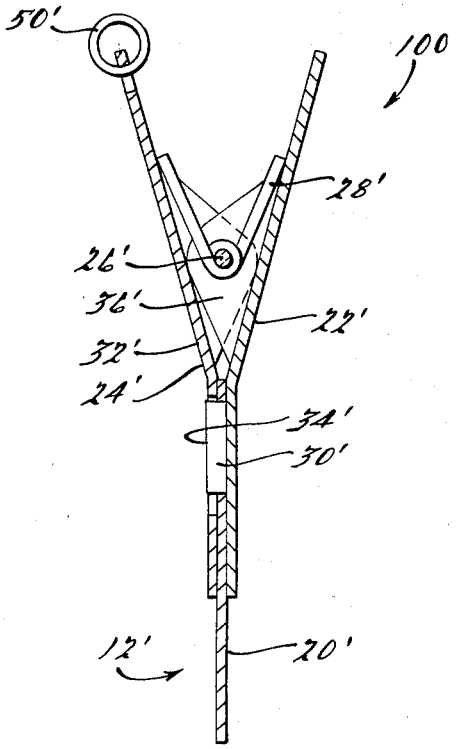
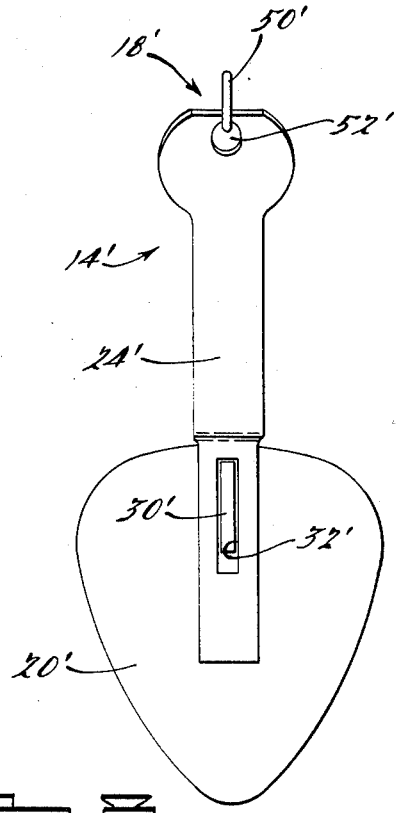
FIG. 8.

MUSIC ARTICLE JEWELRY SYSTEM

BACKGROUND AND SUMMARY OF THE INVENTION

The present invention relates generally to an apparatus for removably yet stably retaining and attractively suspending an article for playing a musical instrument. The invention relates particularly to a jewelry system which includes a clip removably retaining a guitar pick encased by a sleeve, the clip and pick having means for holding the pick in position in the clip, and the clip being suspended by a chain.

Musicians often use articles for playing certain musical instruments. For example, a musician may use a plectum, such as a guitar pick, to pick or strum a stringed instrument. When the playing article, particularly a small oe such as a guitar pick, is not attached to the instrument itself, it is easily lost or misplaced. The musician thus risks either having the article out of reach at the moment of play or losing the article altogether. Therefore it would be advantageous to provide the musician with an apparatus for keeping the article close at hand in an attractive way which will enable the apparatus to double as a piece of jewelry. The apparatus doubling as a jewelry system must also ensure that the music article is removably yet stably retained within the apparatus, so that the article can be quickly retrieved without worry that the article will become detached from or change position relative to the portion of the apparatus retaining the article.

Accordingly, it is a principal object of the present invention to provide an attractive apparatus for keeping an article used for playing a musical instrument, such as a plectrum, close at hand or easily accessible.

It is an additional object to provie meas for removably yet stably retaining said article.

It is a more specific object of the present invention to provide an apparatus for suspending a plectrum around the neck of the musician in a way which provides an ornamental appearance and jewelry-like quality to the apparatus.

To achieve the foregoing objects, the present invention provides a music article jewelry system which generally comprises a clip for removably retaining an article for playing a musical instrument, such as a guitar pick, and a suspension element connected to the clip. The clip and guitar pick include a fin for stabilizing the pick's rotational position relative to the clip.

Additional advantages and features of the present invention will become apparent from a reading of the detailed description of the embodiments of the apparatus which makes reference to the following set of drawings in which:

BRIEF DESCRIPTION OF THE DRAWINGS

FIG. 7 is a perspective view of a music article jewelry system according to another embodiment of the present invention.

FIG. 8 is a front elevation view of the music article jewelry system shown in FIG. 7.

FIG. 9 is a side view of a cross-section of themusic article jewelry system shown in FIG. 8.

FIG. 10 is a side view of a two-armed clip, according to the present invention, the clip shown in an open position with a portion of the clip broken away, particularly illustrating the fin slot on an attaching arm of the clip and a stabilizing fin on the stabilizing arm of the clip.

DETAILED DESCRIPTION OF THE PREFERRED EMBODIMENTS

Figure 1:
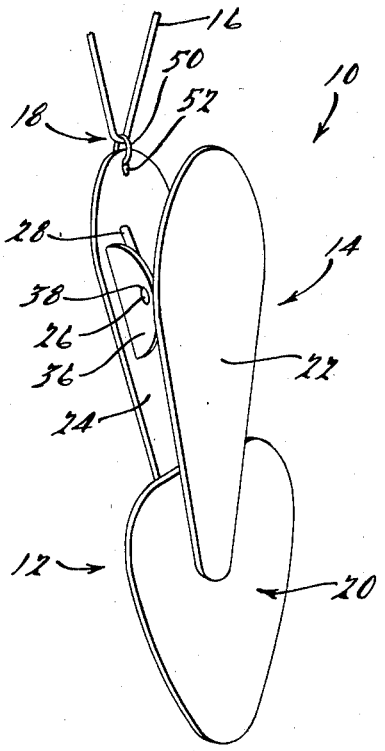
FIG. 1 is a perspective view of a music article jewelry system, according to one embodiment of the present invention.

Referring to FIG. 1, a perspective view of a music article jewelry system or apparatus 10 is shown. The apparatus 10 includes a music article 12, a spring-loaded clip 14, and a flexible loop element 16 connected to a clip 14 by a connecting device 18. In accordance with one embodiment of the present invention, the music article 12 comprises a plectrum 20 of the type generally used to strum or play a stringed musical instrument such as a guitar. However, it should be appreciated that the principles of the present invention are susceptible to use with other relatively small articles for playing a musical instrument and that other suitable music articles may be used in the appropriate application.

Referring generally to FIGS. 1–4, the clip 14 is shown to comprise a pair of opposing arms 22–24, a pin 26 for connecting these arms, and a spring element 28 which is coiled around the pin 26 for biasing the arms 22–24 together at their tapered end. While it is preferred that the clip 14 be of the spring-loaded type, it should be understood that other suitable devices may be used. Thus, for example, it may be appropriate in some applications for a clasp or clamp to be used in place of the clip 14.

Referring again to FIGS. 1–4, the clip 14 generally includes two opposing arms 22–24. Eachof the arms 22–24 has two generally planar opposing faces. Each arm 22–24 is generally rigid and oval in shape, tapered at one end and rounded at the other. It should be appreciated, however, that the shape of the arms 22–24 may vary, and that any suitable shape, such as a triangular or rectangular shape, may suffice. The arms 22–24 of the clip 14 are biased by the spring element 28 which is secured between the arms 22–24 by the pin 26. The pin 26 permits the clip's opposing arms 22–24 to pivot around the spring element 28. The spring element 28 biases the tapered ends of the clip arms 22–24 adjacent and the rounded ends of the arms 22–24 apart. Upon depression of the rounded ends of the arms 22–24, which brings the rounded ends adjacent, the clip 14 opens in a jaw-like movement to allow placement or removal of the music article 12 between the clip arms 22–24. While the clip 14 and its spring element 28 and pin 26 may be constructed of metal, it should be appreciated that any suitable material, such as plastic, may be used.

Figure 4:
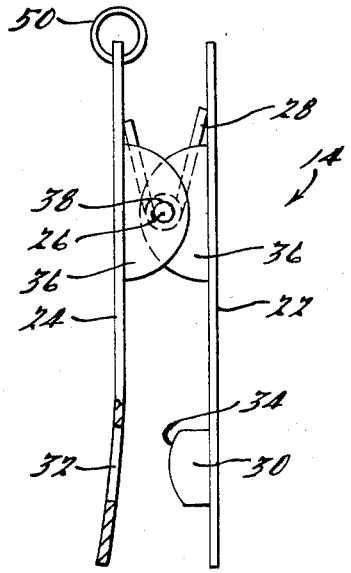
FIG. 4 is a side view of a two-armed clip, according to the present invention, the clip shown in an open position with a portion of the clip broken away, particularly illustrating a fin slot on an attaching arm of the clip and a stabilizing fin on the stabilizing arm of the clip.
Figure 3:
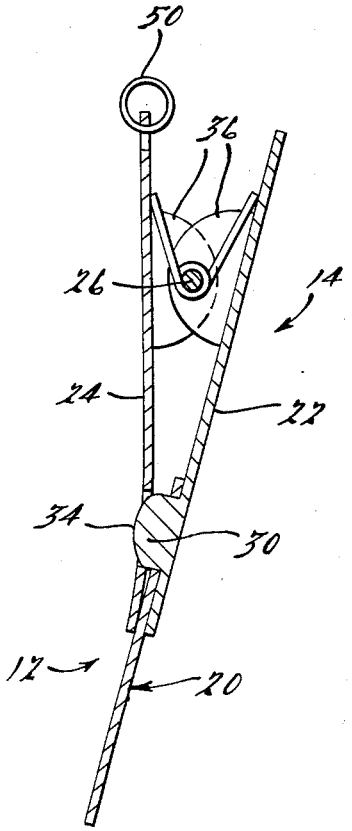
FIG. 3 is a side view of a cross-section of the music article jewerly system shown in FIG. 2.
Figure 2:
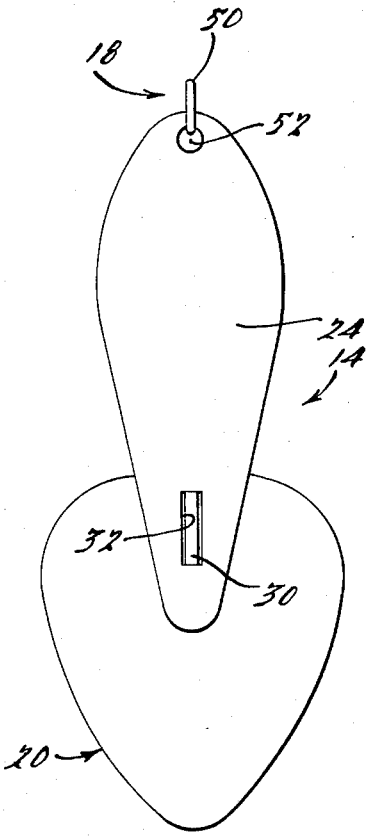
FIG. 2 is a front elevation view of the music article jewelry system shown in FIG. 1.

Referring to FIGS. 2–4, the first opposing arm of the clip 14 is a stabilizing arm 22, which includes a projecting stabilizing feature which is generally rigid stabilizing fin 30 projecting perpendicularly and lengthwise from one of the planar faces of the stabilizing arm 22. The stabilizing fin 30 is generally rigid and is preferably roughly rectangular in shape and constructed of metal. However, it should be appreciated that this stabilizing fin 30 need not be rectangular in shape, but may be roughly semi-circular or triangular or of any suitable shape, and that the stabilizing fin 30 may be constructed of any suitably material instead of metal. In this regard, the stabilizing fins will prevent the article/pick from rotating on the clip, so that the pick will be maintained in the most attractive positio and promote its use as a piece of jewelry for the musician. It should further be appreciated that the projecting stabilizing feature need not be a single projection nor a fin but may be any number of projections in any configuration.

The second opposing arm of the clip 14 is the attaching arm 24, which has a projection receiving feature which generally includes a fin slot 32 through the planar surface of the arm. The fin slot 32 is complementary in size and shape to the edge 34 of the stabilizing fin 30 most distal fromthe stabilizing fin's point of projection from the attaching arm 24. The fin slot 32 of the attaching arm 24 receives the stabilizing fin 30 of the attaching arm 24, and their engagement stabilizes the positio of the music article 12 when the article is retained by the clip 14. It should be appreciated, however, that while the projection receiving feature may be a fin slot 32, any suitable receiving feature, such as one or more grooves or depressions may suffice.

Both the stabilizing arm 22 and attaching arm 24 of the clip 14 further include a set of flanges 36. Each arm 22–24 has two flanges, each flange 36 projecting perpendicularly from the planar face of the arm from which it projects. Each projecting flange 36 runs parallel to the longitudinal axis of the arms 22–24 from which it projects, and its point of projection is between the longitudinal axis and one of the longitudinal edges of the arm 22–24 from which it projects. Each flange 36 has two generally planar opposing faces, and is generally rigid and semi-circular in shape. The flanges 36 are preferably constructed of metal, but any suitable material may be employed. Each of the flanges 36 further includes a pin hole 38 through its planar face which allows for passage of the pin 26. The pin 26 secures the spring element 28 between the arms 22–24 of the clip 14 and secures the arms 22–24 to one another.

Figure 5:
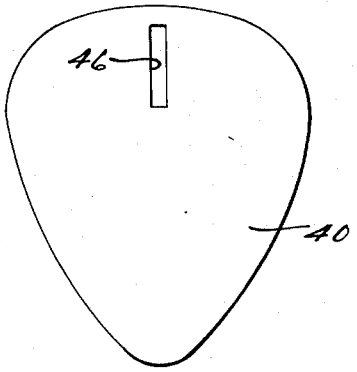
FIG. 5 is a top elevation view of a plectrum, according to the present invention.
Figure 6:
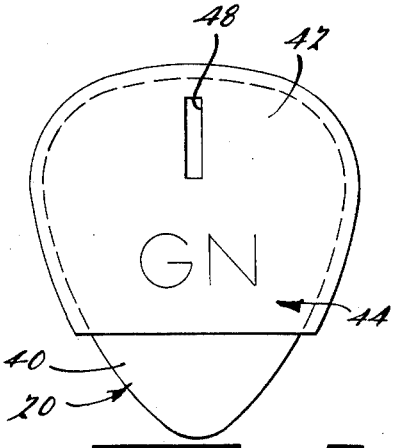
FIG. 6 is a front elevation view of the plectrum comprising a pick encased by a pick sleeve, according to the present invention.

Referring to FIG. 5–6, the music article 12 is shown. The music article 12 comprises a plectrum 20 generally having two opposing planar faces and a roughly isosceles triangular shape with rounded corners and convex sides. However, any suitable shape, such as a roughly equilateral triangular shape, may suffice. The plectrum 20 further comprises a pick 40 and a pick sleeve 42 encasing the pick 40. The pick 40 has two generally planar opposing faces and preferably has a roughly isosceles triangular shape with rounded corners and convex sides and is preferably constructed of plastic. It should be appreciated, however, that, in constructing the pick 40, any sutiable shape, such as a roughly equilateral triangular shape, and any suitably rigid material, such as metal, may be used. The pick sleeve 42 encasing at least a portion of the pick 40 is generally constructed of metal and is preferably of a size large enough to permit inscription of the owner's initials 44 on the pick sleeve 42. However, it should be appreciated that the pick sleeve 42 may be constructed of any suitable material such as plastic or wood, and any inscription, such as an emblem, may be made upon the pick sleeve 42, or no inscription need be made at all. Both the pick 40 and pick sleeve 42 include slots, a pick slot 46 and sleeve slot 48, respectively. These slots 46–48 are complementary in size and shape to one another and to the edge 34 of the stabilizing fin 30 most distal to the stabilizing fin's point of projection from the stabilizing arm 22. The pick slot 46 and sleeve slot 48 receive the stabilizing fin 30 of the stabilizing arm 22 when the clip 14 retains the plectrum 20.

Referring again to FIG. 1, the clip 14 retaining the plectrum 20 is suspended by suspension means comprising a flexible loop element 16, preferably a looped cord. It should be appreciated, however, that a length of any suitable flexible yet sturdy material, such as a chain, string of beads, plastic strip, leather strap, braided yarn, a ribbon, or an elastic band, may be employed. The clip 14 of the apparatus also includes a connecting device 18, preferably a rigid metal connecting rig 48 which passes through a ring aperture 50 through the planar face of the rounded end of the attaching arm 24 of the clip 14. It should be apprciated, however, that the connecting ring 48 may be constructed of any suitable material, such as plastic. It should further be appreciated that the connecting device 18 need not even be a rigid connecting ring 48 through which the flexible loop element 16 passes, but can be any device of connection such as a soldered or glued piece of material connecting the attaching arm 24 of the clip 14 to the flexible loop element 16. The flexible loop element 16, joinable at its ends, passes through the connecting ring 48 and loops upon itself. The flexible loop element 16 can thus encircle any suspending structure, such as a neck, wrist, shoulder, ear, wall hook or peg, and suspend the clip 14 ad pick element 12 which is retained by the clip 14. Moreover, the music article jewelry.

Referring to FIGS. 7–10, another embodiment of a music article jewelry system 100 according to the present invention is shown. All features present in the first embodiment illustrated in FIGS. 1–6 are included in the second embodiment illustrated in FIGS. 7–10, and corresponding features in the drawings of the second embodiment are assigned primed numbers corresponding to those in the drawings of the first embodiment. Although each embodiment contains the same features, eachpair of flanges 36' of the clip 14' of the second embodiment, in contrast to the flanges 36 of the clip 14 in the first embodiment, projects perpendicularly and directly 102' from the longitudinal edge of one of the clip arms 22–24, the flanges 36' being molded or cast or formed of one piece with the clip 14'. The flanges 36' in the second embodiment are thus preferably constructed of metal, as are the arms 22'–24' of the clip 14', but any material suitable for construction of the clip 14' will also be suitable for the construction of the flanges 36' which are of one piece of the arms 22'–24' from which they project. The clip 14' of the second embodiment also varies slightly in shape from the clip 14 of the first embodiment, the rounded ends of the second clip's 14' arms 22'–24' being flattened at their apex, the mid-portion of the arms 22'–24' being narrower than the mid-portion of the arms 22–24 of the clip 14 of the first embodiment, and the ends of the second clip's 14' arms 22'–24' being flush to one another at their tapered ends. A further variation between the disclosed embodiments is the flexible loop element 16, 16'. The flexible loop element 16 illustrated in the first embodiment comprises a cord whereas the flexible loop element 16' in the second embodiment employs a chain.

It will be appreciated that the above disclosed embodiments are well calculated to achieve the aforementioned objects of the present invention. In addition, it is evident that those skilled in the art, once given the benefit of the foregoing disclosure, may now make modifications of the specific embodiments described herein without departing from the spirit of the present invention. Such modifications are to be considered within the scope of the present invention, which is limited solely by the scope and spirit of the appended claims.

What is claimed is:

1. An apparatus, comprising:

an article for playing a musical instrument;

means for removably retaining said article when said article is not in use, said retaining means including stabilizing means for holding said article in a predetermined position on said retaining means, said stabilizing means having a cross-sectional shape which includes at least one planar face; and suspending means for attractively suspending said retaining means independently of said musical instrument;

said article having means for receiving said stabilizing means of said retaining means, said retaining means being complimentary in shape of the cross-sectional shape of said stabilizing means.

2. The apparatus of claim 1, wherein said article for playing a musical instrument comprises a plectrum having two generally opposing planar faces, said plectrum having a roughly isosceles triangular shape with rounded corners and convex sides.

3. The apparatus of claim 2, wherein said retaining means comprises a clip having:

a spring element biasing a pair of opposing arms together at one end; and a pin securing said spring element between said arms and securing said arms to one another, said pin allowing said arms topivot around said spring.

4. The apparatus of claim 3, wherein said stabilizing means comprises a projection formed on said clip.

5. The apparatus of claim 4, wherein said suspending means comprises a flexible loop element looped upon itself.

6. The apparatus of claim 5, wherein one of said arms is a stabilizing arm;

said stabilizing arm having two generally planar opposing faces;

said stabilizing arm being generally rigid and oval in shape, rounded at one end and tapered at the other; and said stabilizing arm including said projection which is a generally rigid stabilizing fin.

7. The apparatus of claim 6, wherein said stabilizing fin has two generally planar opposing faces;

said stabilizing fin is generally roughly rectangular in shape;

said stabilizing fin projects lengthwise and perpendicularly from one of said planar faces of said stabilizing arm; and said stabilizing fin projects from said stabilizing arm more proximally from the tapered end than the rounded end of said stabilizing arm.

8. The apparatus of claim 7, wherein one of said arms is an attaching arm;

said attaching arm having two generally planar opposing faces;

said attaching arm being generally rigid and oval in shape, rounded at one end and tapered at the other; and said attaching arm including means for receiving said projection, comprising a fin slot extending lengthwise through the planar faces of said attaching arm.

9. The apparatus of claim 8, wherein each of said arms includes a set of two flanges;

each of said flanges projecting perpendicularly from one of the planar surfaces of one of said arms;

each of said flanges having two generally planar opposing faces;

each of said flanges being generally rigid and generally semi-circular in shape;

each set of said flanges on one of said arms contacting the set of flanges on the opposing arm on at least a portion of the flanges' planar faces;

each of said flanges having a pin hole through its planar surface, said pin hole being generally equidistant from the point of projection of said flange from said arm and the outer semicircular edge of said flange; and each of said pin holes allowing for passing of said pin through the planar surface of said flange, said pin securing said spring between said arms and said arms to one another.

10. The apparatus of claim 8, wherein each of said arms includes a set of two flanges;

each of said flanges projecting perpendicularly and directly from longitudinal edges of the planar surface of one of said arms.

11. The apparatus of claim 8, wherein said fin slot is generally rectangular in shape;

said fin slot having a size and shape complementary to the edge of said stabilizing fin, which edge is the edge most distal from the point of projection of said stabilizing fin from said stabilizing arm;

said fin slot having a position on said attaching arm complementary to the position of said stabilizing fin on said stabilizing arm;

said fin slot receiving said stabilizing fin when the planar faces of said opposing arms are brought adjacent at their tapered ends.

12. The apparatus of claim 11, said plectrum is a pick, said pick generally having two generally opposing planar faces and having a roughly isosceles triangular shape with rounded corners and convex sides;

the base of said pick being the base of said isosceles triangle;

said pick including a pick slot through the planar surface of said pick, said pick slot being located near the base of said pick, and said pick slot having a size and shape complementary to said fin slot; and said pick slot receiving said stabilizing fin when said pick is positioned between the tapered ends of said stabilizing and attaching arms for retention of said pick by said clip.

13. The apparatus of claim 12, wherein said plectrum further comprises a pick sleeve having four generally planar faces;

said pick sleeve generally being roughly quadrangular in shape and said pick sleeve having a shape complementary to said base of said pick;

said pick sleeve being closed at one end and open at the other and said pick sleeve encasing at least a portion of said base of said pick;

said pick sleeve being of a size large enough to accommodate an inscription upon said pick sleeve; and said pick sleeve including a sleeve slot having a shape and size complementary to said pick slot when said pick is encased by said pick sleeve.

14. The apparatus of claim 11, wherein said clip includes a connecting device for connecting said clip to said flexible loop element;

said connecting device comprising a generally rigid connectign ring; and said clip havig a ring aperture through the planar surface of the rounded end of said attaching arm, said ring aperture following for passage of said connecting ring for connecting said flexible loop element to said clip.

15. The apparatus of claim 14, wherein said flexible loop element comprises a strip of material joinable at the ends of said strip;

said strip passes through said connecting ring and loops upon itself; and said strip forms a loop for encircling a suspending structure and suspending said clip which retains said pick element.

16. A musical article jewelry system comprising:

means for picking having an aperture therethrough, said aperture having a cross-sectional shape which includes at least one planar face;

clip means for removably retaining said picking means, said clip means having a projection for cooperating with said aperture of said picking means to fixedly stabilize the position of said picking means on said clip means; and loop means for suspending said clip means.

17. The jewelry systemof claim 16, wherein said loop means comprises a flexible member which includes ring means for attaching said clip meas to said flexible member.

18. The jewelry system of claim 16, wherein said clip means comprises a spring-loaded clip;

said clip includes two opposing arms;

said clip further includes a first arm having said projection;

said clip further includes a second arm having an opening which receives said projection.

19. The jewelry system of claim 16, wherein said picking means includes a pick and pick cover;

said pick and pick cover each having an aperture; and said pick aperture and pick cover aperture receiving said projection of said clip means when said picking means is retained by said clip means.

20. A guitar pick jewelry system comprising:

a bracelet;

a clip attached to said bracelet; and a guitar pick removably retained by said clip to permit playing of a guitar with said guitar pick;

said clip having a stabilizing fin which extends into a complementary slot of said guitar pick to fixedly secure said guitar pick onto said clip when said guitar pick is not in use.

* * * * *

UNITED STATES PATENT AND TRADEMARK OFFICE

CERTIFICATE OF CORRECTION

PATENT NO. : 4,779,778

DATED : October 25, 1988

INVENTOR(S) : George Nixon, II

It is certified that error appears in the above-identified patent and that said Letters Patent is hereby corrected as shown below:

Col. 1, line 19 "oe" should be --one--
Col. 1, line 38 "provie meas" should be --provide means--
Col. 2, line 13 "themusic" should be --the music--
Col. 2, line 48 "Eachof" should be --Each of--
Col. 3, line 12 "suitably" should be --suitable--
Col. 3, line 15 "positio" should be --position--
Col. 3, line 25 "fromthe" should be --from the--
Col. 3, line 28 "positio" should be --position--
Col. 4, line 22 "rig" should be --ring--
Col. 4, line 25 "apprciated" should be --appreciated--
Col. 4, line 37 "ad" should be --and--
Col. 4, line 39 after "jewelry" insert --system may be fashioned in a manner to permit its use as an earring, tie clip, necklace, bracelet or any other suitable piece of jewelry--
Col. 4, line 49 "eachpair" should be --each pair--

Col. 5, line 30 "retaining" (second occurrence) should be --receiving--
Col. 5, line 44 "topivot" should be --to pivot--
Col. 7, line 15 "connectign" should be --connecting--
Col. 7, line 16 "havig" should be --having--
Col. 7, line 18 "following" should be --allowing--
Col. 8, line 9 "meas" should be --means--

Signed and Sealed this

Thirtieth Day of May, 1989

*Attest:*

*Attesting Officer*

DONALD J. QUIGG

*Commissioner of Patents and Trademarks*